US007421064B2

(12) United States Patent
Frenk

(10) Patent No.: US 7,421,064 B2
(45) Date of Patent: Sep. 2, 2008

(54) ROTATABLE, WATER-COOLED X-RAY SOURCE

(75) Inventor: Guenther Frenk, Au Am Rhein (DE)

(73) Assignee: Bruker AXS GmbH, Karlsruhe (DE)

( * ) Notice: Subject to any disclaimer, the term of this patent is extended or adjusted under 35 U.S.C. 154(b) by 0 days.

(21) Appl. No.: 11/979,747

(22) Filed: Nov. 8, 2007

(65) Prior Publication Data

US 2008/0112539 A1 May 15, 2008

(30) Foreign Application Priority Data

Nov. 15, 2006 (DE) ..... 10 2006 053 760

(51) Int. Cl.
*H01J 35/10* (2006.01)

(52) U.S. Cl. ..... 378/141; 378/119; 378/200

(58) Field of Classification Search ..... 378/119, 378/130, 141–144, 199, 200
See application file for complete search history.

(56) References Cited

U.S. PATENT DOCUMENTS

| | | | | |
|---|---|---|---|---|
| 4,064,411 | A | 12/1977 | Iwasaki et al. | |
| 5,299,249 | A * | 3/1994 | Burke et al. | 378/15 |
| 6,160,868 | A * | 12/2000 | Snyder et al. | 378/127 |
| 7,186,022 | B2 * | 3/2007 | Charles et al. | 378/200 |
| 2005/0175147 | A1 | 8/2005 | Brauss | |
| 2006/0239408 | A1 | 10/2006 | Durst | |

FOREIGN PATENT DOCUMENTS

| | | |
|---|---|---|
| EP | 0 633 712 | 1/1995 |
| GB | 374 227 | 6/1932 |

OTHER PUBLICATIONS

Broshure, "Diffraction Solutions D8 Advance" X-Ray Solutions, Bruker AXS, 2006.
Broshure, "Thin Film Solutions D8 Discover", Bruker Advanced X-Ray Solutions, Bruker AXS, 2002.
Broshure, "X-Pert Materials Research Diffractometer system", Philips Analytical.

* cited by examiner

*Primary Examiner*—Irakli Kiknadze
(74) *Attorney, Agent, or Firm*—Paul Vincent

(57) ABSTRACT

The invention describes an X-ray source in which a cooling plate (36) for water-cooling the anode (28) of an X-ray tube (26) is firmly mounted on a radiation protection casing (20) and the X-ray tube (26) is rotatably borne relative to the cooling plate (36) in the radiation protection casing (20). The cooling plate (36) and X-ray tube (26) have small axial play with respect to each other, which allows for rotation. Radial seals (R1, R2) ensure adequate sealing of the cooling water throughout the entire axial play. Advantageously, a sealing plate (27) for adaptation to the cooling plate (36) is attached to the X-ray tube (25). With the X-ray source in accordance with the invention, it is easy to switch between various focus types in one casing structure.

14 Claims, 4 Drawing Sheets

PRIOR ART

ROTATABLE, WATER-COOLED X-RAY SOURCE

This application claims Paris Convention priority of DE 10 2006 053 760.2 filed Nov. 15, 2006 the complete disclosure of which is hereby incorporated by reference.

BACKGROUND OF THE INVENTION

The invention concerns a water-cooled X-ray source for generating both a point focus as well as a line focus comprising a radiation protection casing, an X-ray tube element, which is inserted into the radiation protection casing and has a filament and an X-ray anode, a cooling plate having water channels for cooling the X-ray anode of the X-ray tube element, a spray jet via which cooling of the X-ray anode takes place, wherein the spray jet has a slit arranged parallel to the filament, and cooling water channels to the cooling plate, wherein the radiation protection casing, the cooling plate and the cooling water channels are firmly connected to each other.

Such an X-ray source is known, for example, through the company publication "Diffraction solutions D8 ADVANCE" by Bruker AXS GmbH, Karlsruhe 2006.

X-ray diffraction is a powerful instrumental analysis method, with which a specimen is exposed to a generally monochromatic X-ray beam and a deflection of the X-ray beam, generally brought about by diffraction on the crystalline lattice of the specimen material, is measured.

X-ray radiation is generated in an X-ray tube by way of electrons emerging from a glowing filament which are accelerated onto an X-ray anode in an electrical field. When the electrons strike the anode, they are decelerated and X-ray radiation is released.

An elongated filament can be used both to produce a point focus as well as a line focus. In the former case, the filament is aligned parallel to the effective radiation direction, in the latter case the filament is perpendicular to the effective radiation direction. An X-ray tube designed for both types of focus has at least one exit window for each type of focus. In order to select a focus type for an experiment, an appropriate exit window of the X-ray tube is used.

When the electrons are decelerated on the anode, the anode heats up and is cooled in order to prevent it from burning through. Cooling water is supplied to the rear of the anode using a spray nozzle which is parallel (e.g. the exit slit) to the filament.

In the case of the "D8 ADVANCE" type X-ray device, a cooling plate is arranged on the X-ray tube through which cooling water channels pass. The cooling water channels supply the spray nozzle, which is, in turn, connected to the cooling plate. The cooling plate is supplied with cooling water via cooling water pipelines arranged rigidly on the radiation protection casing. In order to avoid incorrect assembly, a predetermined, fixed alignment of the cooling plate vis-à-vis the radiation protection casing is given by way of an index pin; in the same way, a particular fixed alignment of the cooling plates vis-à-vis the X-ray pipe is also given by an index pin.

In order to change the focus in the "D8 ADVANCE" type X-ray source, the X-ray source, including the cooling water flow, has to be switched off and largely dismantled. Another cooling plate (replacement cooling plate also known as a 90° cooling plate) with cooling water connections/index pins displaced through 90° is mounted on the X-ray tube and the protective casing. Changing the focus is therefore extremely time-consuming and there is the risk of leaking residual cooling water into the sensitive X-ray apparatus.

From the company document "X'pert Materials Research Diffractometer system—new horizons in materials research" by Philips Analytical, Almelo, Netherlands, an X-ray tube has become known in which the cooling water pipelines are integrated into a mountable cooling plate. In this way, the X-ray tube can be turned in a protective casing in order to change the focus. However, this X-ray tube is large and cumbersome due to the cooling water pipelines passing through it; the rear connection elements of the cooling water to the X-ray tube—hoses, for example, also have to be rotated when changing the focus. Integration of the cooling water pipelines also increases the cost of the X-ray tube; the X-ray tube is a special component.

Departing therefrom, the aim of the present invention is to provide an X-ray source with which it is possible to easily change between different types of focus, wherein conventional X-ray tubes can preferably be used in the X-ray source.

SUMMARY OF THE INVENTION

This task is solved in a surprisingly simple but effective way by the X-ray source of the type set out above, which is characterized in that the spray nozzle is connected to the X-ray tube element, and the X-ray tube element is rotatable by at least 90° vis-à-vis the cooling plate about an axis perpendicular to the plane of the cooling plate, wherein two radial seals are provided between the cooling plates and the rotatable X-ray tube element, of which the first radial seal seals off the cooling water from the surroundings and the second radial element of the spray nozzle seals off incoming cooling water from the returning cooling water so that the sealing effect is also retained when the X-ray tube element is turned vis-à-vis the cooling plate.

In accordance with the invention, the cooling plate and the X-ray tube element are rotatable through 90° (or more) with respect to each other in order to change the focus. Through rotation, a desired exit window of the X-ray tube element (or an X-ray tube of the X-ray tube element) can be brought into the radiation beam through which the focus (strip focus or line focus) is set for an experiment. By way of the radial seals between the cooling plate and X-ray tube element, it is possible to provide axial play between the cooling plate and the X-ray tube element for the purpose (and preferably for the duration) of a rotation of the X-ray tube element in the protective casing, wherein adequate sealing of the cooling water is guaranteed. A change in focus can take place with the X-ray source in accordance with the invention without dismantling the X-ray source; more particularly, no replacement cooling plate is required and the cooling water channels and pipelines do not have to be opened.

In accordance with the invention, the X-ray tube element is rotatably arranged on the cooling plate. The cooling plate is rigidly connected to the radiation protection casing assembled in the overall X-ray apparatus so that the cooling water pipeline also does not have to be changed (moved for example) when changing the focus. This simplifies handling and integration of the cooling water pipelines into the X-ray tube element becomes superfluous.

A preferred embodiment of the X-ray source in accordance with the invention envisages that the X-ray tube element has a sealing plate facing the cooling plate and an X-ray tube, more particularly a commercially available standard X-ray tube, wherein the sealing plate and the X-ray tube are firmly connected to each other. In accordance with the invention, the sealing plate allows an adaptation of the anode side of the X-ray tube to the other components of the X-ray source so that, in principle, any type of X-ray tube, more particularly cost-effective commercially available X-ray tubes, can be used. Furthermore, the spray nozzle can be wedged and held securely between the sealing plate and X-ray tube. The position (alignment) of the spray nozzle with regard to the X-ray tube element can be determined by means of an index pen (or another index means).

In an advantageous further development of this embodiment, an axial seal is envisaged between the sealing plate and the X-ray tube. At little cost, the axial seal prevents cooling water from leaking into the surroundings.

In a preferred embodiment, clamping means are provided with which the cooling plate and the X-ray element can be axially pressed onto each other in various relative rotating positions. The clamped state can be easily reproduced, thereby improving the reproducibility of X-ray measurements in the clamped state. The sealing effect in the clamped state is also more reliable. Particularly advantageously, additional stops are provided for rotating positions/measuring positions to be clamped.

A further development of this embodiment envisages that the clamping means comprise a clamping plate and clamping screws, wherein the cooling plate is arranged between the clamping plate and the X-ray tube element. This arrangement has proven itself in practice. The clamping screws are easily loosened and refastened so that focus changing can take place simply and quickly.

In an advantageous further development of this embodiment, limiting means are provided that are firmly connected to the cooling plate and grip the clamping plate so that axial play of the clamping plate is limited, wherein the limiting means preferably at least partially cover the clamping screws so that the axial path of the clamping screws between the clamped and unclamped state of the cooling plate and X-ray element is limited. This further development simplifies loosening and clamping of the cooling plate and clamping plate to each other. The clamping plate is only loosened and cannot be lost. The covering of the clamping screws helps to only carry out the necessary loosening of the clamping screws when changing the focus.

In a very particularly preferred embodiment, stop means are provided to limit the maximum axial distance between the cooling plate and X-ray tube element, more particularly to an axial play of 2 mm or less. This ensures that the cooling plate cannot be lost relative to the X-ray tube element, which improves handling.

In a preferred further development of this embodiment, the stop means comprise a central screw, wherein the central screw is preferably fastened with its thread in the cooling plate, and a collar of the screw grips an edge of the X-ray tube element (preferably the sealing plate). The central screw has proven itself in practice. The central screw can be hollow and thereby act as a cooling water supply, preferably as a supply to the spray nozzle. The spray nozzle can be disposed over the central screw.

Particularly preferred is an embodiment in which the X-ray source has two stops for relative positions of the cooling plate and X-ray tube element displaced about 90°. The stops are provided for a line focus position and a strip focus position. With the stops, the reproducibility of measurements can be improved.

An embodiment is also preferred in which the relative rotating position of the cooling plate and X-ray tube element is continuously adjustable, so that the projected size of the tube focus for the application can be optimized.

Finally, another embodiment is preferred in which the X-ray tube element is connected by way of a spring contact to a high-voltage supply. The spring contact is preferably provided in a plug of the high-voltage supply line. In this way, twisting of the high-voltage supply line during focus changing can be avoided.

Further advantages of the invention are set out in the description and the drawings. In accordance with the invention, the aforementioned and further described features can be used individually or together in any combination. The embodiments shown and described should not be understood as an exhaustive list, but rather as examples to describe the invention.

The invention is shown in the drawing and will be described in more detail by way of embodiments.

DESCRIPTION OF THE PREFERRED EMBODIMENT

Figure 1:
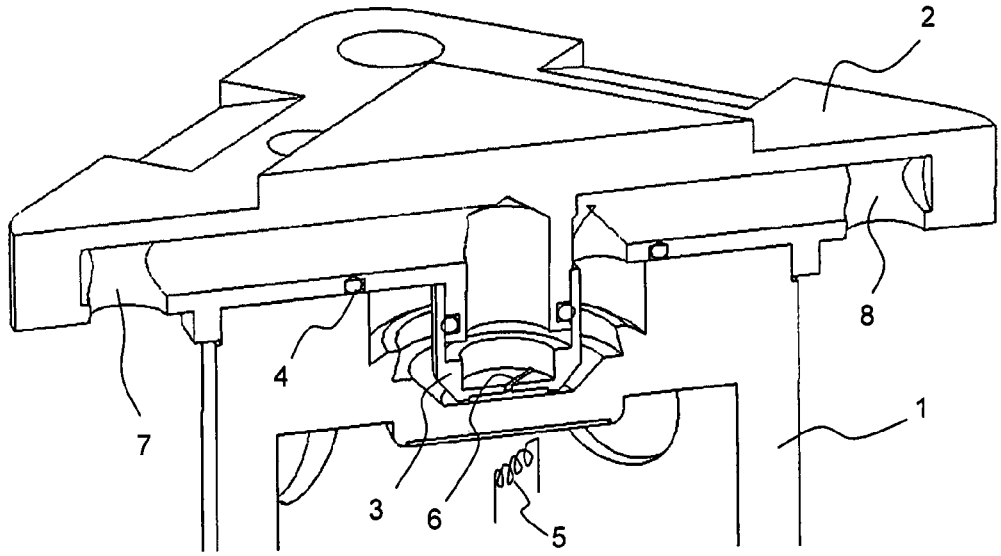
FIG. 1 shows a schematic perspective cross-section through an X-ray source of prior art.

Commercially available X-ray sources for fine structure examination, as shown for example in FIG. 1 without an X-ray protection casing, essentially comprise an X-ray emitter (here also referred to as X-ray tube 1), cooling plate 2 and spray nozzle 3. The cooling plate 2 is mounted on the X-ray tube 1 and axially sealed, cf. seal 4. This produces a fixed arrangement between the position of the filament 5, the alignment of the spray nozzle (cf. slit 6), the water supply 7, and water supply 8. Furthermore, the position of the externally provided water supply is static, i.e. it is also fixed with regard to the surrounding structure (radiation protection casing). Alignment is effected by positioning pegs and positioning holes (not shown in FIG. 1).

On the application side of these X-ray sources, the filament has to be used both perpendicularly to the effective radiation (known as line focus) as well as longitudinally to the effective radiation (known as point focus) using just one device.

In order to allow conversion from line focus to point focus, a so-called 90° cooling plate is currently used, which replaces the normal cooling plate 2. With this cooling plate, 90° rotation of the X-ray emitted 1 and the spray nozzle 1 is realized with proper alignment.

When changing the focus there are a number of disadvantages the installation has to be completely switched off;

the water flow must be switched off;

the X-ray emitter must be dismantled;

when opening the water channel, residual water can penetrate into sensitive areas;

time consuming.

These disadvantages are eliminated by the X-ray source in accordance with the invention. An embodiment of an X-ray source in accordance with the invention is shown in FIGS. 2 to 7.

Figure 2:
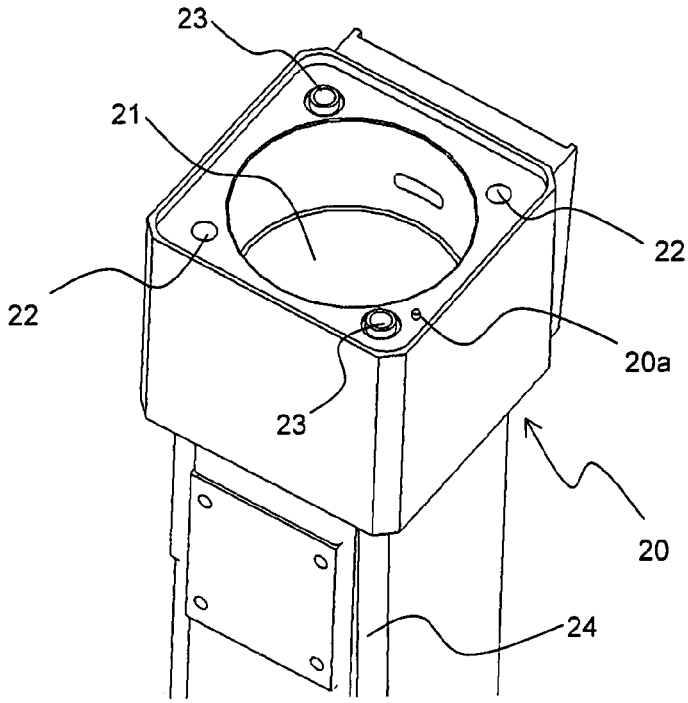
FIG. 2 shows a schematic perspective view of a radiation protection casing for use with the present invention.

FIG. 2 initially shows a radiation protection casing 20 for use with the present invention. The radiation protection casing shields X-ray radiation. An X-ray tube element can be arranged in the interior 21 of the radiation protection casing 20. On the upper side of the radiation protection casing there are two drilled holes 22 with an internal thread into which fastening screws for a mountable cooling plate can be screwed (cf. the drilled holes 22*a* of the cooling plate 36 in FIG. 3). Furthermore, there are connections 23 for cooling water (or another fluid coolant) for the cooling plate. The connections 23 constitute end sections of cooling water pipelines 24, which are rigid on and/or in the radiation protection casing. One of the connections 23 is the cooling water inlet, the other the cooling water outlet.

An index pin 20*a* is also visible in FIG. 2 and ensures that a cooling plate can only be mounted on the protective casing 20 in the correction orientation.

The radiation protection casing is typically firmly mounted in a device assembly (measurement assembly), for example rigidly or also on a pivotable goniometer arm.

Figure 4:
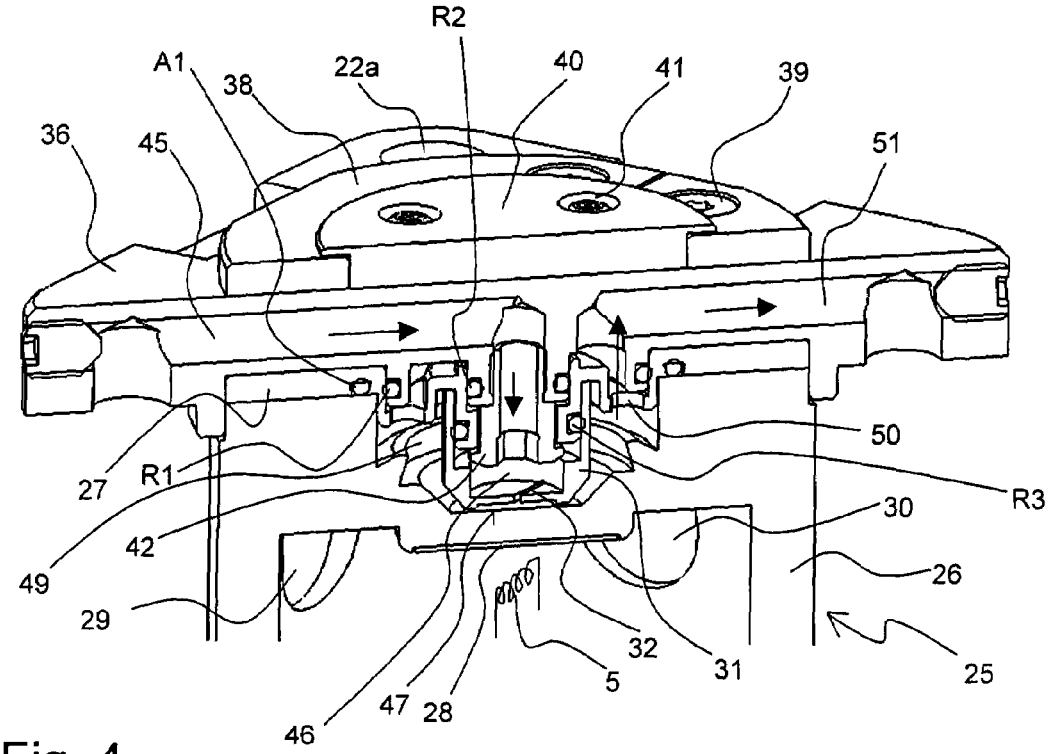
FIG. 4 shows a schematic perspective view of a cross-section through the embodiment of FIG. 3.
Figure 5:
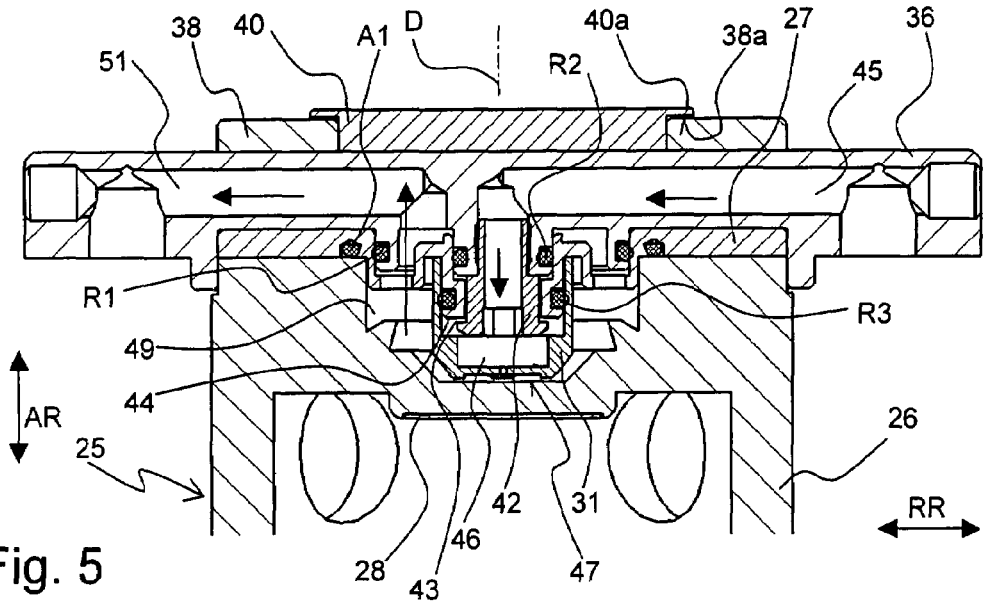
FIG. 5 shows a schematic cross-section through the embodiment of FIG. 3.
Figure 6:
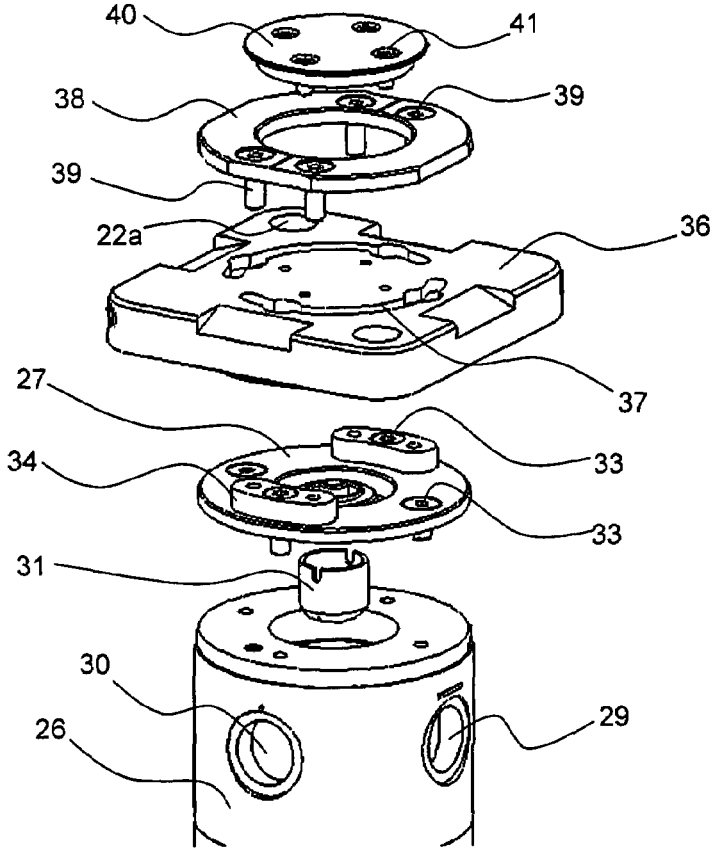
FIG. 6 shows a schematic exploded perspective view from above of the embodiment of FIG. 3.
Figure 7:
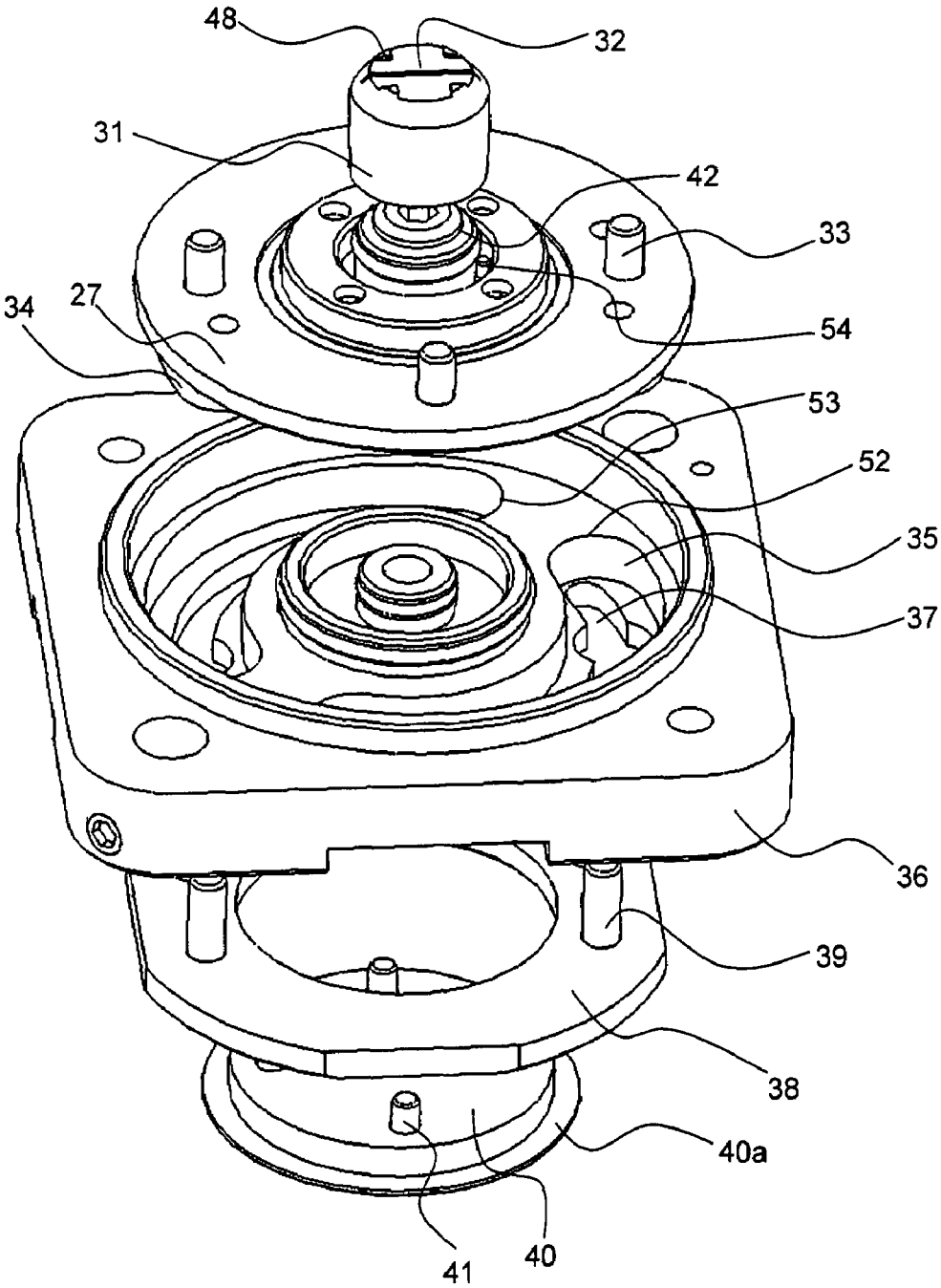
FIG. 7 shows a schematic perspective exploded view from below of the embodiment of FIG. 3.

In the embodiment shown, the X-ray source has an X-ray tube element 25, comprising an X-ray tube (or X-ray emitter) 26 and a sealing plate 27, cf. more particularly FIG. 4, FIG. 5 and FIG. 6. The X-ray tube 26 and sealing plate 27 are firmly connected to each other by means of four screws 33.

The X-ray tube 26 has a longitudinal filament 5 which is opposite an anode The X-ray tube 26 has a first exit window 29, which lies perpendicular to the filament 5, and a second exit window 30 which lies longitudinally to the filament 5. The exit windows 29, 30 have beryllium panes.

A spray nozzle 31 is mounted between the X-ray tube 26 and the sealing plate 27 and firmly orientated vis-à-vis these components, for example by means of an index pin 54 or index recesses. The spray nozzle 31 has a slit (or outlet gap) 32 aligned in parallel to the filament 5.

The upper side of the sealing plate 27 has two circular arc-shaped projections 34 which can engage in circular arc-shaped recesses 35 on the underside of a cooling plate 36. The projections 6 and the recesses 35 act as guides for a mutual rotating movement of the X-ray tube element 25 and cooling plate 36. The axis of rotation D runs perpendicular to the cooling plate 36 through the center of the cooling plate 36 (cf. FIG. 5). The base of the recesses has slit-shaped openings 37.

Arranged on the cooling plate 36 is a clamping plate 38, which is annular in shape. Clamping screws connect the clamping plate 38 to the sealing plate 27, more precisely to the projections 34. When the clamping screws 39 are tightened, the cooling plate 36 is held firmly between the clamping plate 38 and the sealing plate 27, wherein the clamping screws 39 penetrate the slit-shaped openings 37.

The clamping plate 38 is held on the radial inner edge by limiting means 40, here designed as a cover plate. The limiting means 40 are attached to the cooling plate 38 with four screws 41. The limiting means 40 restrict axial play of the clamping plate 38 vis-à-vis the cooling plate 36.

Figure 3:
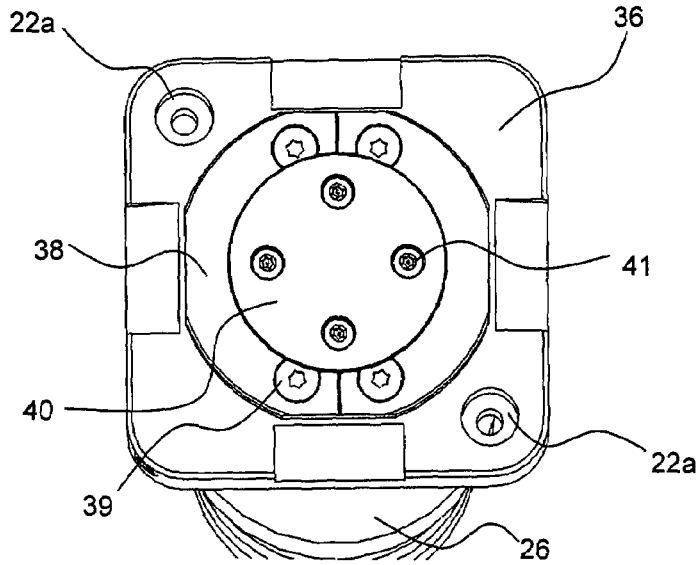
FIG. 3 shows a schematic top view of an embodiment of an X-ray source in accordance with the invention.

The limiting means 40 also cover the heads of the clamping screws 39 (see in particular FIG. 3). This restricts unscrewing of the clamping screws 39. If each of the clamping screws 39 is turned once, axial play of the cooling plate vis-à-vis the X-ray tube element 25 is restricted. The distance between the limiting means 40 (and/or the part 40*a* above them) and the clamping plate 38 (and/or covered section 38*a*) in the axial direction AR (cf. FIG. 5) is typically only approx. 0.05-0.20 mm, just enough to cancel out the clamping effect between the sealing plate 27 and the cooling plate 36 with the axial play of the clamping plate 38.

In addition, a hollow, central screw 42 is a stop means which limits the axial play between the sealing plate 27 and the cooling plate 36. The central screw 42 is screwed into the cooling plate 36 and has a collar 43 covering an edge 44 of the sealing plate 27. The axial distance between the collar 43 and edge 44 restricts the axial play of the sealing plate 27 and cooling plate 36 in an absolute manner, this axial distance in the clamped state is typically 2 mm or less.

Cooling of the anode 28 by means of cooling water takes place by way of a cooling water flow (of the flow of another fluid coolant) through the cooling plate 36, through the spray nozzle 31 and in an intermediate space limited by the sealing plate 27 and the upper side of the X-ray tube 26.

Via a supply-side cooling water channel 45 of the cooling plate 36, cooling water (cf. arrows) flows through the central screw 42 into the internal area 46 of the spray nozzle. From the spray nozzle 31, the cooling water flows through the slit 32 at high pressure onto a surface 47 of the X-ray tube 26 to be cooled, which runs parallel and adjacent to the anode 28. The cooling water flows laterally out under the spray nozzle 31 (the spray nozzle 31 rests with four feet 48 on the surface 47 to be cooled, cf. FIG. 7) into an outer area 49 of the spray nozzle 31. From there, the cooling water flows on through at least one hole 50 in the sealing plate 27 into a return-side cooling water channel 51 of the cooling plate 36.

The outer area 49 of the spray nozzle 31 is sealed vis-à-vis the surroundings by a first radial seal R1; the first radial seal R1 forms a seal between the sealing plate 27 and the cooling plate 36. To seal the outer area 49 vis-à-vis the surroundings there is also an axial seal A1 between the sealing plate 27 and the upper side of the X-ray tube 26.

Incoming water is largely sealed off from retuning water by way of a second radial seal R2 between the sealing plate 27 and cooling plate 36. This ensures an adequate flow on the surface 47 to be cooled through the slit 32. A third radial seal R3 between the spray nozzle 31 and sealing plate 27 serves the same purpose.

To change the focus, the clamping screws 39 are unscrewed and the clamping plate 38 loosened. The cooling plate 36 thereby acquires axial play between the clamping plate 38 (and/or its axial upper stop) and the sealing plate 27. In other words, the cooling plate 36 can distance itself slightly from the sealing plate 27 in an upward axial direction AR. Since the seals R1, R2 between the X-ray element 25 (here its sealing plate 27) and the cooling plate 36 are designed as radial seals (i.e. the sealing rings, made of elastic material, such as rubber for example, are pressed together in a radial direction RR), the sealing effect is retained over the axial play required for rotation. The sealing rings can simply slide along in an axial direction on the opposing wall running parallel to the axial direction. The opposite walls extend sufficiently in the axial direction (corresponding to the maximum axial play of the cooling plate 36 and X-ray tube element 25 as defined by the central screw 42 as the stop element).

The other seals R3, A1 do not experience any movement of the opposite sealed walls through the axial play.

In the loosened state, the X-ray tube element 25 can be turned vis-à-vis the cooling plate 36 (and therefore vis-à-vis the protective casing 20). The limitation of the recesses 35 for the projections 34 define two stops 52, 53 which correspond to a line focus position and a point focus position, respectively. For some applications, an intermediate size X-ray focus can also be advantageous; the size of the focal point can be set in accordance with the invention by an intermediate position of the X-ray tube element/the projections 34 between the stops 52, 53.

The cooling plate is radially sealed over the sealing plate, which also forms a seal to the X-ray tube. The four clamping screws penetrate the cooling plate and are screwed into the sealing plate. The play in the cooling plate permits turning of the X-ray source, after loosening the clamping screws and turning the clamping plate over the clamping screws. The end positions are highly reproducible through internal stops.

Essential aspects of the X-ray sources in accordance with the invention:

radial sealing of the cooling plate;
externally implemented rotation of the X-ray tube;
no dismantling of the high-voltage plug necessary;
the water flow does not have to be turned off;
no separation of the water channels and therefore no emergence of residual water;
highly reproducible end positions;
adjustability of the visible focus size by partial rotation of the X-ray tube;
exchangeability of the X-ray emitter is retained as before (service, e.g. X-ray emitter with another anode type);
compatible with the currently used types of X-ray tubes;
the function of the sealing plate can also be integrated into the X-ray emitter.

In summary, the invention describes an X-ray source in which a cooling plate for water-cooling the anode of an X-ray tube is firmly mounted on a radiation protection casing, wherein the X-ray tube is rotatably borne vis-à-vis the cooling plate in the radiation protection casing. The cooling plate and X-ray tube have small axial play with respect to each other, which permits rotation. Radial seals ensure adequate sealing of the cooling water throughout the entire axial play. Advantageously, a sealing plate for adaptation to the cooling plate is attached to the X-ray tube. With the X-ray source in accordance with the invention it is easy to switch between various focus types in one casing structure.

I claim:

1. A water-cooled X-ray source for generating both a point focus and also a line focus, the source comprising:

a radiation protection casing;

an X-ray tube element inserted into said radiation protection casing, said X-ray tube element having an X-ray anode and a filament;

a cooling plate having cooling water channels for cooling said X-ray anode, said cooling plate firmly connected to said radiation protective casing, said X-ray tube element structured to rotate relative to said cooling plate through at least 90° about an axis perpendicular to a plane of said cooling plate;

a spray nozzle for cooling said X-ray anode, said spray nozzle having a slit running parallel to said filament and being connected to said X-ray tube element;

channels to provide cooling water to said cooling plate, said cooling water channels firmly connected to said radiation protection casing and to said cooling plate;

a first radial seal disposed between said cooling plate and said X-ray tube element to seal cooling water from surroundings; and a second radial seal disposed between said cooling plate and said X-ray tube element to seal cooling water flowing to said spray nozzle from returning cooling water, so that a sealing effect is also retained while rotating said X-ray tube element relative to said cooling plate.

2. The X-ray source of claim 1, wherein said X-ray tube element has a sealing plate facing said cooling plate and an X-ray tube or commercially available, standard X-ray tube, wherein said sealing plate and said X-ray tube are firmly connected to each other.

3. The X-ray source of claim 2, wherein an axial seal is provided between said sealing plate and said X-ray tube.

4. The X-ray source of claim 1, further comprising clamping means to axially press together said cooling plate and said X-ray tube element in various relative rotation positions.

5. The X-ray source of claim 4, wherein said clamping means comprise a clamping plate and clamping screws, wherein said cooling plate is disposed between said clamping plate and said X-ray tube element.

6. The X-ray source of claim 5, further comprising limiting means which are firmly connected to said cooling plate and grip said clamping plate so that axial play of said clamping plate is restricted.

7. The X-ray source of claim 6, wherein said limiting means at least partially cover said clamping screws so that an axial path of said clamping screws between clamped and unclamped states of said cooling plate and said X-ray tube element is restricted.

8. The X-ray source of claim 1, further comprising stop means to restrict a maximum axial distance between said cooling plate and said X-ray tube element.

9. The X-ray source of claim 8, wherein said maximum axial distance is restricted to an axial play of 2 mm or less.

10. The X-ray source of claim 8, wherein said stop means comprise a central screw attached, with a thread thereof, in said cooling plate, wherein a collar of said screw grips an edge of said X-ray tube element.

11. The X-ray source of claim 1, wherein the X-ray source has two stops for relative positions between said cooling plate and said X-ray tube element which are displaced by 90°.

12. The X-ray source of claim 1, wherein a relative rotational position of said cooling plate and said X-ray element is continuously adjustable so that a projected size of a tube focus can be optimized.

13. The X-ray source of claim 1, wherein said X-ray source element is connected to a high-voltage supply by means of a spring contact.

14. The X-ray source of claim 13, wherein said spring contact is disposed in a plug of a high-voltage supply line.

* * * * *